United States Patent [19]

Takahata

[11] Patent Number: 4,688,786

[45] Date of Patent: Aug. 25, 1987

[54] SHEET HANDLING APPARATUS

[75] Inventor: Naomi Takahata, Yokohama, Japan

[73] Assignee: Canon Kabushiki Kaisha, Tokyo, Japan

[21] Appl. No.: 828,589

[22] Filed: Feb. 10, 1986

Related U.S. Application Data

[63] Continuation of Ser. No. 498,314, May 26, 1983, abandoned.

[30] Foreign Application Priority Data

Jun. 1, 1982 [JP] Japan ..... 57-94598

[51] Int. Cl.[4] ..... B65H 39/10; G03G 15/00

[52] U.S. Cl. ..... 271/294; 271/296; 271/199; 271/288; 355/3 SH; 355/14 R

[58] Field of Search ..... 271/294, 296, 297, 287, 271/288, 290, 207, 176, 199; 355/3 SH, 4 SH, 14 R

[56] References Cited

U.S. PATENT DOCUMENTS 4,408,756 10/1983 Miyashita et al. ..... 271/296 X 4,449,812 5/1984 Furuichi et al. ..... 271/294 X

*Primary Examiner*—Joseph J. Rolla

*Assistant Examiner*—Gregory L. Huson

*Attorney, Agent, or Firm*—Fitzpatrick, Cella, Harper & Scinto

[57] ABSTRACT

A sheet sorter which generates a signal for enabling image formation before the sheet sorter becomes ready for sheet handling, thereby reducing the time required for the first image recording.

12 Claims, 11 Drawing Figures

SHEET HANDLING APPARATUS

This application is a continuation of application Ser. No. 498,314, filed May 26, 1983, now abandoned.

BACKGROUND OF THE INVENTION

1. Field of the Invention

The present invention relates to a sheet handling apparatus for sorting and storing copy sheets, recording sheets or the like.

2. Description of the Prior Art

For the purpose of sorting and storing the copy sheets, recording sheets or the like transported, after image formation, from an image forming apparatus such as copier, duplicator or other recording instrument, there has been employed a sheet handling apparatus (hereinafter called sorter) in combination with such image forming apparatus.

Such sorter is generally provided with ten to twenty sheet receiving trays, and the sheets consecutively ejected from the image forming apparatus such a as copier at a regular interval are stored in succession into said trays by means of conveyor belts and/or plural rollers.

Among such sorters there is already known a sorter in which the sorting and storage of sheets are achieved by moving the trays in succession to a position corresponding to the sheet ejecting exit of the copier or the like.

Such sorter is activated by a sorter start signal, generated from the copier simultaneously with the actuation of the copy start button, to move the trays to a position corresponding to a first tray, and, upon completion of said tray movement a stand-by signal is supplied from the sorter to the copier to initiate the image forming operation therein. Consequently the time required for forming the first copy becomes longer, by the time required to move said trays to the first tray position, in comparison with the case where such sorter is not used.

In recent years, the sorters are often constructed as independent units connectable to various copiers. Therefore, the sorter of the above-explained kind, if connected to a copier of a short first copying time, is unable to fully utilize the advantage of such copier.

SUMMARY OF THE INVENTION

In consideration of the foregoing, an object of the present invention is to provide a sheet handling apparatus which does not prolong the first recording time, or the time required for obtaining the first copy.

Another object of the present invention is to provide a sheet handling apparatus which enables the image forming operation before said apparatus reaches a stand-by state in which it is ready for sheet handling.

Still another object of the present invention is to provide a sheet handling apparatus which is capable of releasing a stand-by signal, indicating the stand-by state of said sheet handling apparatus, with selectable timing.

The foregoing and still other objects of the present invention will become fully apparent from the following description.

BRIEF DESCRIPTION OF THE DRAWINGS

FIGS. 5-1 and 5-2 are partial views showing a position detecting sensor;

DETAILED DESCRIPTION OF THE PREFERRED EMBODIMENTS

Figure 1:
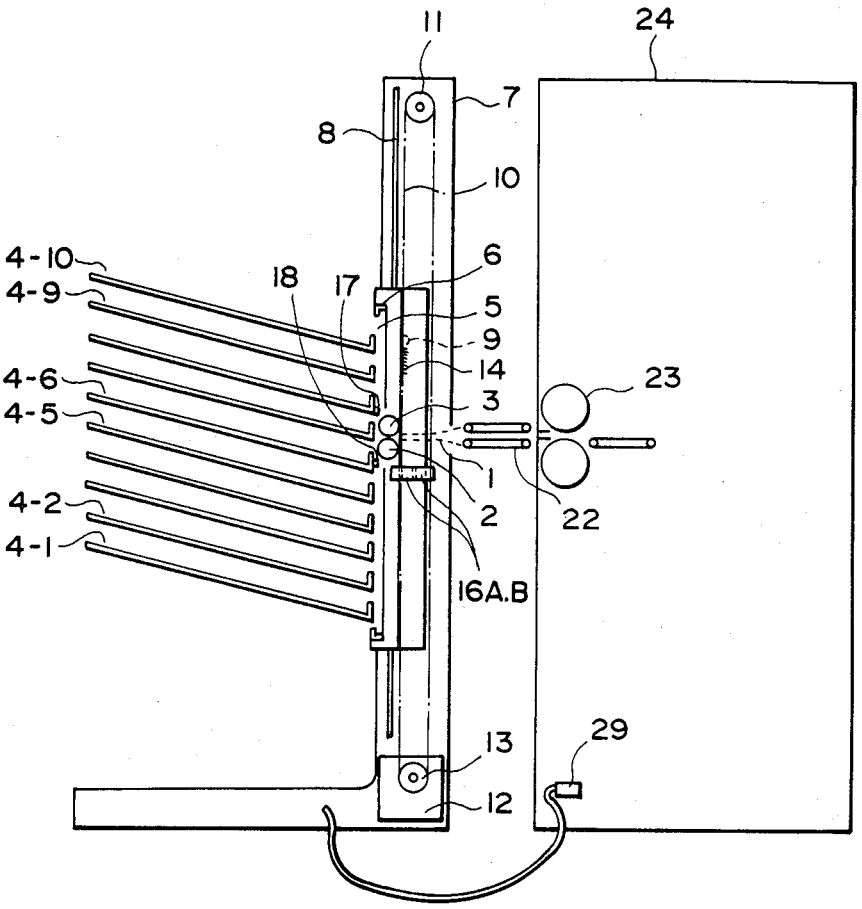
FIG. 1 is a cross-sectional view of a sorter.
Figure 2:
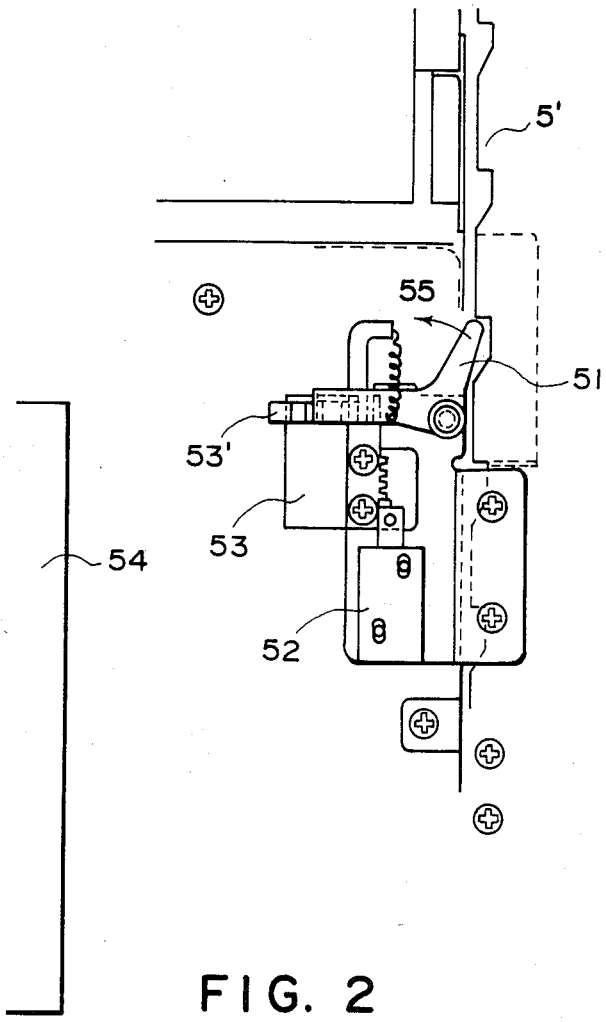
FIG. 2 is a partial view showing a mechanism for releasing drop preventing means and a mechanism for detecting such release.
Figures 1, 5:
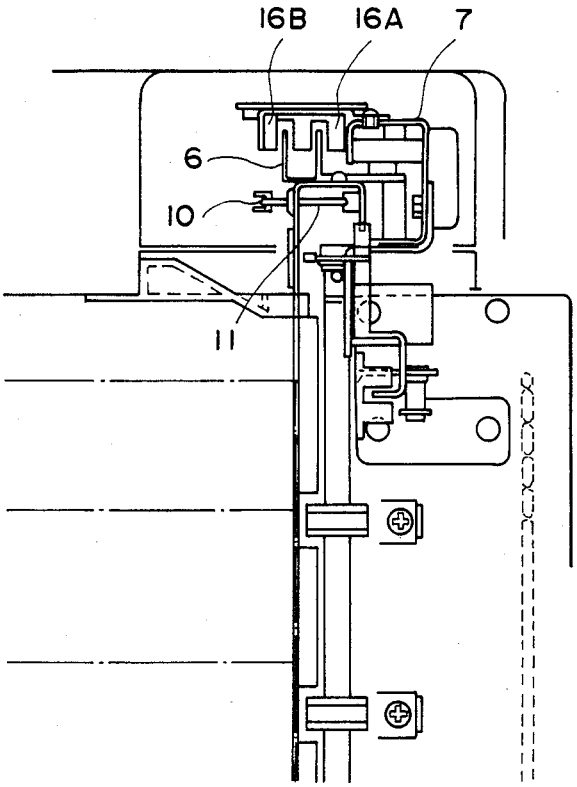
Figures 2, 5:
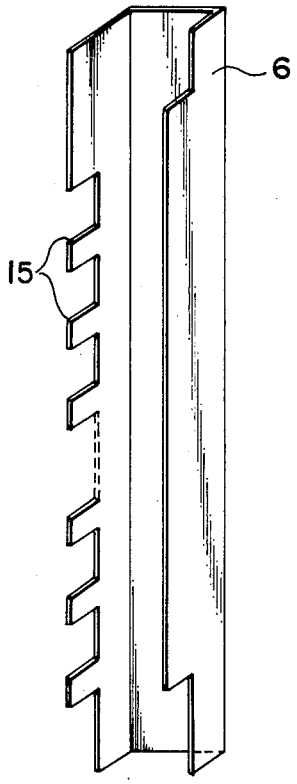

FIG. 1 shows a sorter embodying the present invention in a cross-sectional view, wherein the sheet to be sorted is ejected, after image formation in a copier 24 and image fixation by fixing rollers 23, by conveyor belts 22, then inserted between guide members 1 of the sorter and stored into a tray, for example 4-6, by transport means composed of two movable rollers 2, 3. Trays 4-1, 4-2, . . . , 4-5, 4-6, . . . , 4-9, 4-10 are fixed to a tray frame 5 and to a vertically movable member 6, which is rendered vertically movable, at least over a distance corresponding to the distance from the tray 4-1 to the tray 4-10, along a guide groove 8 of a pillar 7. To the upper end of a chain link member 9 fixed to the vertically movable member 6, there is connected a chain or a wire 10, which is guided by an upper idler roller 11 to a lower sprocket 13 fixed on a shaft of a motor 12 and of which the other end is connected to the lower end of said chain link member 9 through a spring 14. Said spring is provided for compensating the change in the length of said chain and for absorbing the shock in the movement of said chain. Consequently clockwise rotation of the motor 12 elevates the trays 4-1, 4-2, . . . , 4-10 in integral manner. The vertically movable member 6 is provided with recesses 15, as shown in FIG. 5-2, with an interval equal to that of the trays. Thus, when a recess 15 is detected by a position sensor 16A, 16B fixed on the pillar 7, the sheet entrance of a tray corresponding to said recess is positioned at the nip between the rollers 2, 3. Also between said nip of the rollers 2, 3 and the trays there is provided a sheet sensor 17, 18 across the sheet transport path, in order to detect the storage of a sheet into one of the trays.

The function of the above-described sorter will be explained in the following. At first the trays 4-1, . . . , 4-10 are lowered by the rotation of the motor 12. When said trays reach the lowermost position where the position sensor 16A, 16B detect that the sheet entrance of the tray 4-10 is positioned in front of the nip between the rollers 2, 3, the rotation of the motor 12 is stopped and a magnetic brake BK to be explained later is energized. Subsequently a sheet bearing an image thereon is transported into said tray 4-10 by means of the rollers 2, 3, which are driven by a motor to be activated by the copy start signal supplied from the copier. Upon detection of the trailing end of said sheet by the sheet sensor 17, 18, the motor 12 is rotated clockwise until the position sensor 16A, 16B detects a recess 15 corresponding to the tray 4-9. In this state where the sheet entrance of said tray 4-9 is positioned in front of the nip between the rollers 2, 3, the motor 12 is deactivated and the brake is again energized. Thus the sorter is ready to receive a sheet in the tray 4-9.

FIG. 2 shows a claw functioning as means for preventing the fall of the trays and a releasing mechanism therefor. In FIG. 2 there are shown a cam member 5' for engaging with a claw 51 and made integral with said tray frame 5; a plunger 52 for releasing said claw 51; a printed circuit board 53 incorporating control circuit for detecting the release of said claw 51; a photointerrupter-sensor 53' therefor; and a printed circuit board 54 incorporating a control circuit for controlling the apparatus of the present invention.

Figure 3:
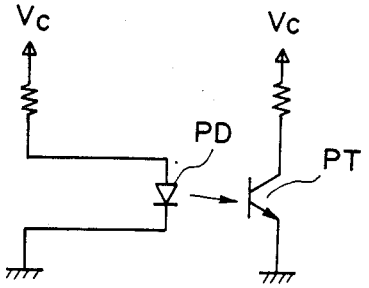
FIG. 3 is a circuit diagram of a photointerrupter.

FIG. 3 shows the circuit structure of the photointerrupter-sensor 53'. Upon energization of the plunger 52, the claw 51 is released from the cam member and rotates in a direction of arrow indicated in FIG. 2, thereby intercepting the light from a photodiode PD to a phototransistor PT and providing a corresponding signal to the control circuit on the printed circuit board 54 as will be explained later.

Figure 4:
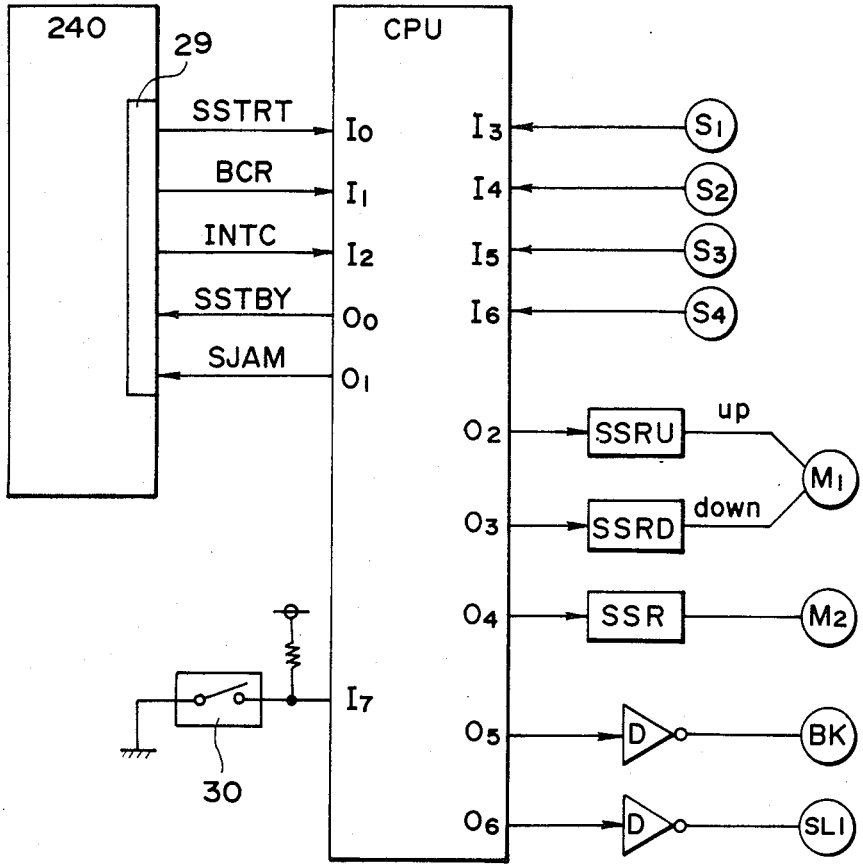
FIG. 4 is a block diagram of a control unit.

FIG. 4 shows the control circuit provided on the printed circuit board 54 and composed principally of a microcomputer or a central processing unit (hereinafter called CPU), which can for example be composed of a 4-bit microcomputer μcom43 supplied by Nippon Electric Company. There are provided input ports I0–I2 for receiving a sorter start signal SSTRT, a tray return signal BCR and an interruption command signal INTC to be supplied from a control unit 240 of the copier 24 as will be explained later; input ports I3–I6 for respectively receiving a signal S1 from the sheet sensor 17, output signals S2, S3 from the tray position sensor 16A, 16B and a signal S4 from the claw release sensor 53'; an input port I7 connected to a dip-switch 30 for selecting the timing of a sorter stand-by signal SSTBY to be supplied to the copier; an output port O0 for releasing the sorter stand-by signal SSTBY; an output port O1 for releasing a sorter jam signal SJAM to the copier; output ports O2, O3 connected through solid-state relays SSRU, SSRD to a motor M1 corresponding to the motor 12 shown in FIG. 1; an output port O4 connected through a solid-state relay SSR to a motor M2 for driving rollers 2, 3; and output ports O5, O6 connected through drivers D1, D2 to a solenoid brake BK and a plunger SL1 corresponding to the plunger 52 shown in FIG. 2.

Now reference is made to FIG. 5-1 showing the position sensors 16A, 16B. The aforementioned vertically movable element 6 is provided in a part thereof with recesses as shown in FIG. 5-2, so that the position of the trays can be detected from the combination of the output signals S2, S3 of said sensors 16A, 16B. The signals S2, S3 respectively in a state "1", "0" indicate that the trays are at the lowermost position in which the tray 4-10 is selected and is in front of the nip between the rollers. The signals S2, S3 respectively in a state "0", "1" indicate that one of the intermediate trays (4-2–4-9) is selected. Also the signals S2, S3 both in a state "1" indicate that the trays are at the uppermost position in which the tray 4-1 is selected.

Figure 6:
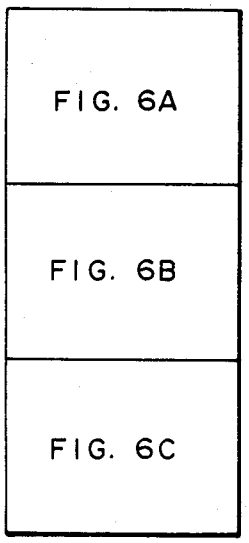
FIG. 6 shows the arrangement of flow charts 6A, 6B and 6C.
Figure 6A:
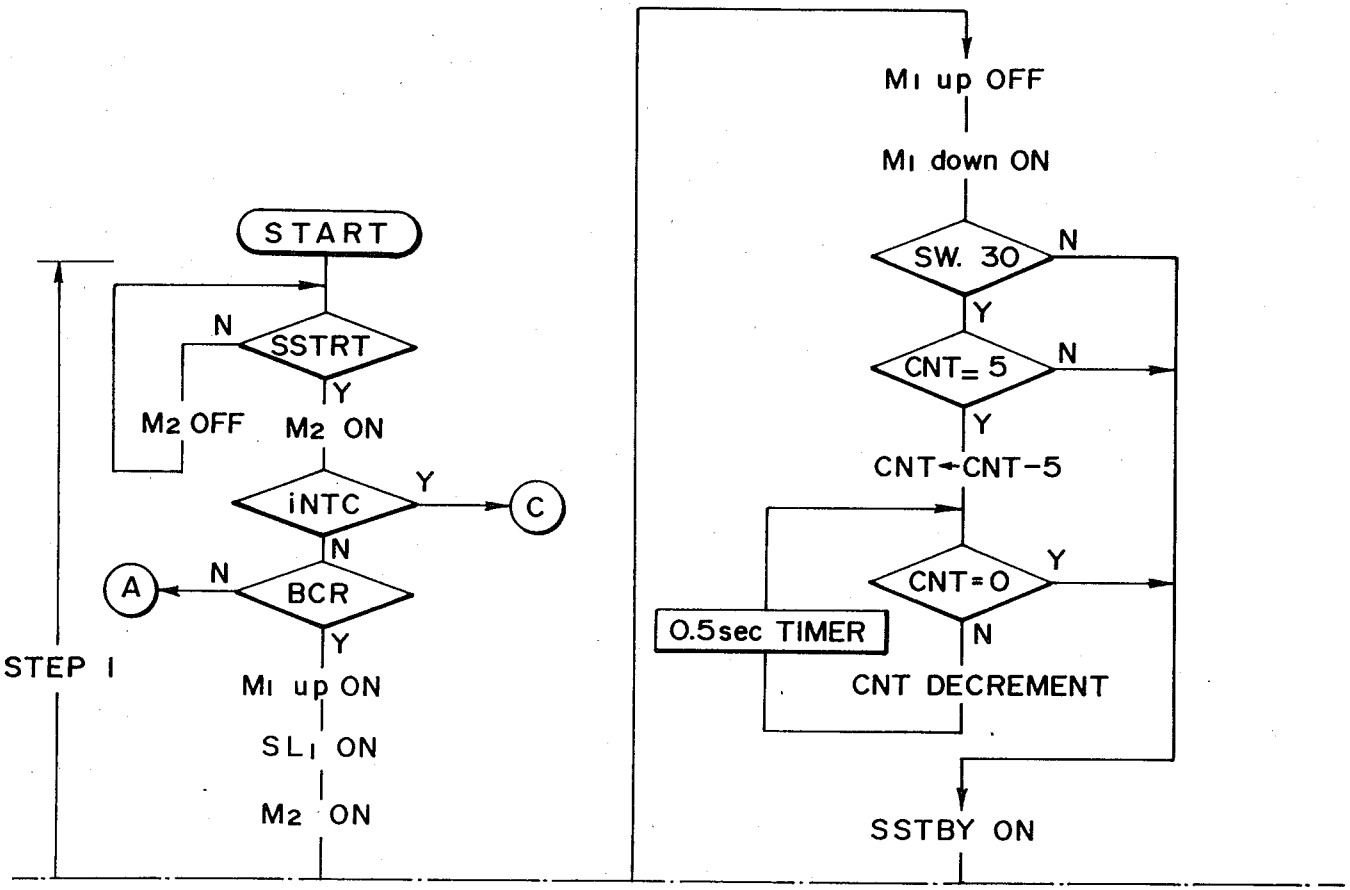
FIGS. 6A, 6B and 6C depict a flow chart showing the control procedure.
Figure 6B:
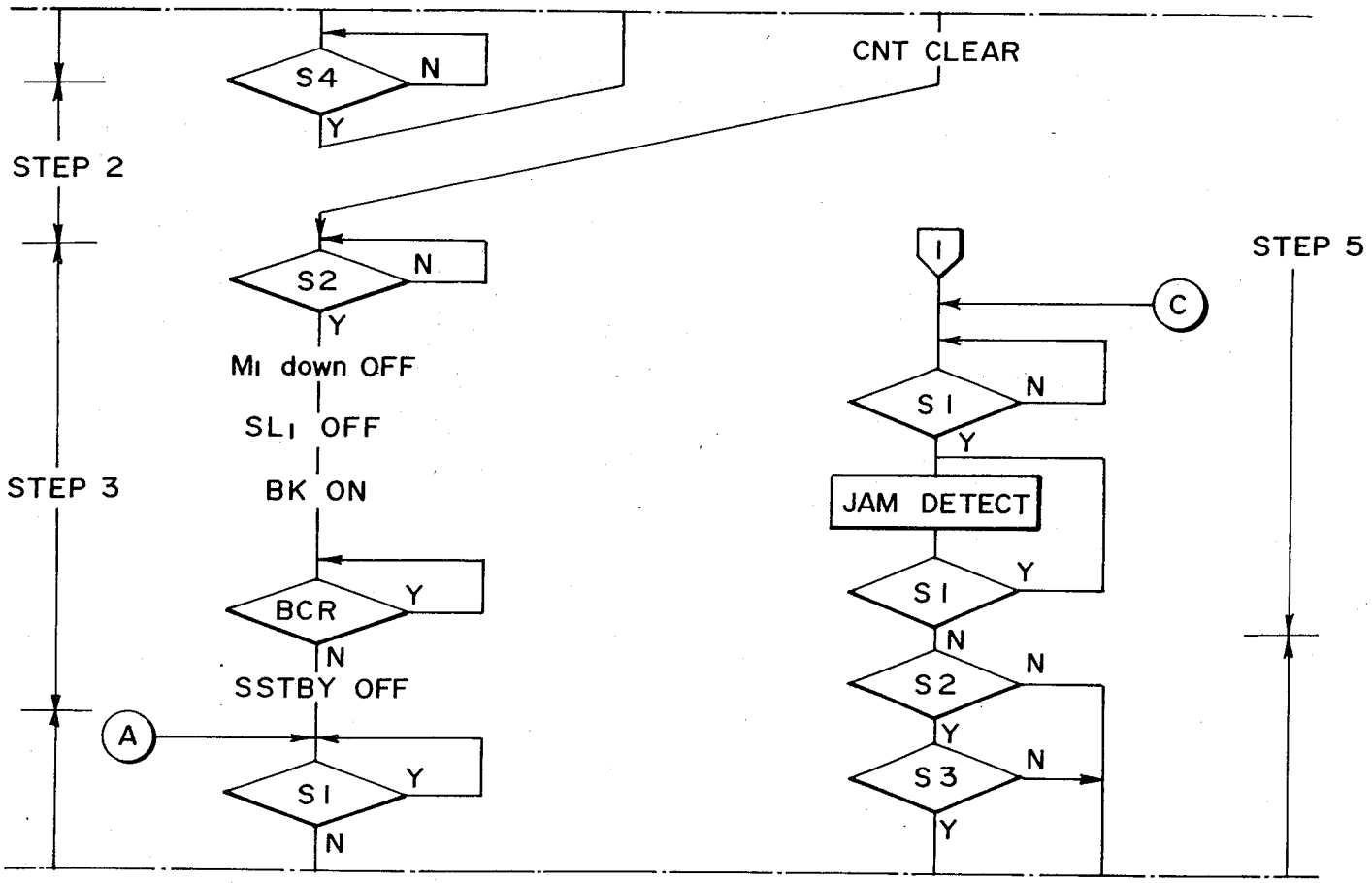
Figure 6C:
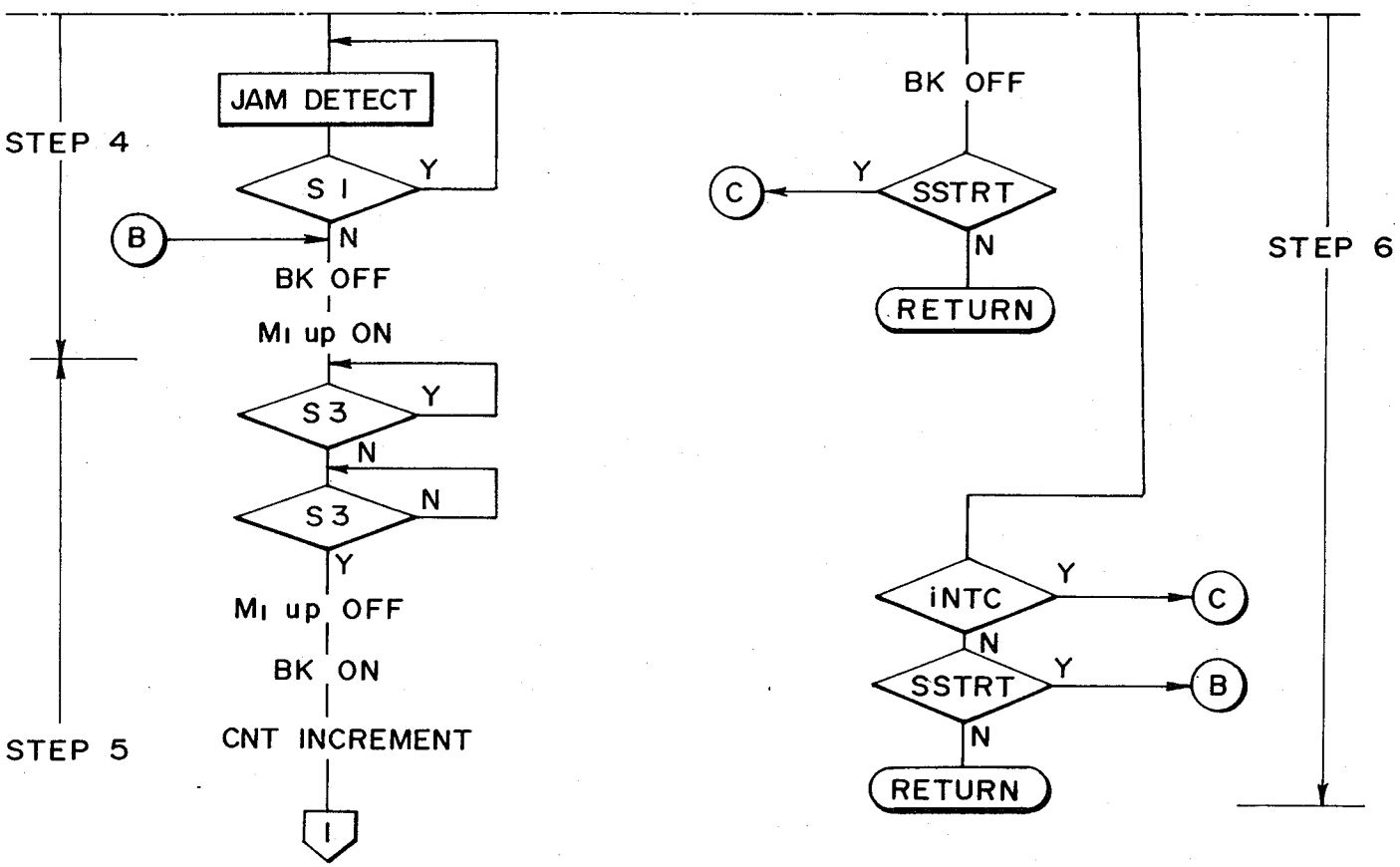
Figure 7:
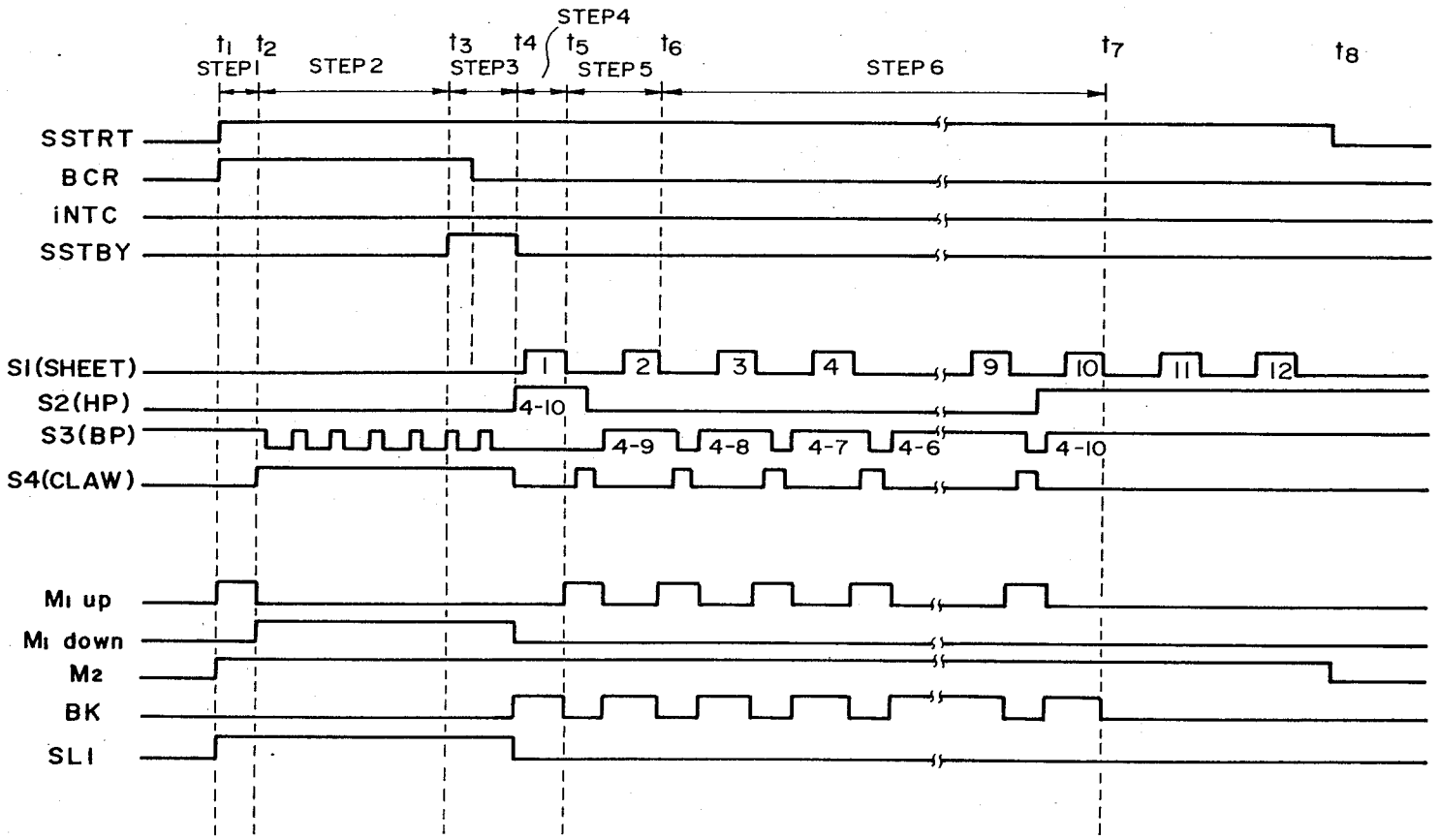
FIG. 7 is a timing chart showing the function of the sorter.

Now the function of the above-described sorter will be explained with reference to a sequential control flow chart shown in FIGS 6A, 6B and 6C and a corresponding timing chart shown in FIG. 7, indicating the functions of various units controlled by said flow chart.

Upon actuation of an unrepresented copy key, the control unit 240 of the copier 24 supplies the sorter start signal SSTRT "1" to activate the motor M2 for driving the rollers 2, 3 and the conveyor belts 22. Then the program jumps to (C) if an interruption command signal is supplied from the copier. In the absence of such interruption command signal, the tray return signal BCR is shifted to the level "1", whereby the output port O2 releases a driving signal to the solid-state relay SSRU to rotate the motor M1 clockwise and thus to elevate the trays. Also the plunger SL1 is energized to release the claw 51, and the program awaits the shift of the signal S4 to the state "1" indicating the detection of release of the claw by the sensor 53'. (Step 1)

When the claw 51 is released to shift the signal S4 to the state "1", the program proceeds to a step 2, whereby the solid-state relay SSRU is turned off. Also a driving signal is released from the output port O3 to turn on the solid-state relay SSRD, thereby driving the motor M1 anticlockwise and lowering the trays. Then the timing of releasing the sorter stand-by signal SSTBY from the output port O0 to the control unit 240 of the copier 24 is judged from the state of the dip-switch 30 and the content of a counter CNT storing the current position of the trays. If the switch 30 is in the off state, the signal SSTBY is immediately released and the counter CNT is cleared, and the program proceeds to a step 3.

On the other hand, in case the switch 30 is closed, the program executes a discrimination whether the content of the counter CNT is less than "5", and, if so, the signal SSTBY is immediately released and the counter CNT is cleared, and the program proceeds to the step 3. If the content of said counter CNT is equal to or exceeds "5", said content is decreased by "5". The above-described procedure is repeated, with a delay time of 0.5 seconds after each decrement, until said content reaches zero. Upon arrival at zero, the signal SSTBY is released to the control unit 240 of the copier 24 and the counter CNT is cleared, and the program proceeds to the step 3.

As an additional explanation to the step 2, in the present embodiment it is assumed that the copier 24 requires 2.5 seconds for the copying operation from the reception of the stand-by signal SSTBY to the ejection of a copy sheet to the exit, while the sorter requires 0.5 seconds for the displacement per tray and 0.5 seconds for the sheet transportation from the exit of the copier to the nip between the rollers 2, 3.

Consequently there will be required:

$$2.5+0.5=3.0 \text{ seconds}$$

for the copying and ejection of a sheet, so that the tray 4-10 has to be moved to the position in front of the nip between the rollers 2, 3 within 3.0 seconds. In the present embodiment, therefore, the stand-by signal SSTBY is released to the copier 24 when the tray 4-5 is in the sheet-receiving position, as the tray 4-10 can be moved to the sheet-receiving position within 2.5 seconds.

When the signal S2 is shifted to "1" and the tray 4-10 reaches the position in front of the nip between the rollers 2, 3, the step 3 turns off the solid-state relay SSRD to deactivate the motor M1 and the plunger SL1, and energizes the brake BK. The sorter stand-by signal SSTBY supplied from the output port O0 to the control unit 240 of the copier 24 in the step 2 continues until the end of the tray return signal BCR released from said control unit 240.

Upon termination of the sorter stand-by signal SSTBY, a step 4 is executed to check sheet remaining jam by means of the sheet sensor 17. The sheet sensor 17 detects the leading and trailing ends of a sheet, and, if the interval of said end detections is longer than a determined time, a remaining jam is identified and a corresponding jam signal SJAM is supplied from the output port O1 of the CPU to the control unit 240 of the copier 24. In the absence of such jam state, the brake BK is deactivated and the motor M1 is turned on through the solid-state relay SSRU to elevate the trays, thereby bringing the next tray 4-9 to the sheet-receiving position.

In a step 5, upon detection of a recess 15 by the position sensor 16B and upon generation of a corresponding signal S3, the motor M1 is deactivated and the brake BK is energized. At the same time the content of the tray position counter CNT is increased by a step. Then the remaining jam of a succeeding sheet is detected in the above-described manner.

Upon detection of the trailing end of the sheet by the sheet sensor 17, a step 6 is executed to identify whether the tray 4-1 is positioned in front of the nip between the rollers 2, 3, i.e. whether the signals S2, S3 are both in the state "1".

If either of the signals S2, S3 is not "1", it is identified that the trays are not yet at the uppermost position. Then the program jumps to (c) if an interruption command signal is present. In the absence of such interruption command signal, the program jumps to (B) or returns to the original state respectively when the signal SSTRT is "1" or not. On the other hand, in case the signals S2, S3 are both in the state "1", indicating that the tray 4-1 is selected, the brake BK is deactivated and the program jumps to (C) or returns to the original state respectively when the signal SSTRT is "1" or not.

In this manner the activation of the motor M1 and the deactivation of the brake are repeated in response to the detection of the trailing end of each sheet ejected from the copier, and the movement of trays is terminated when the selection of the tray 4-1 is identified from the signals S2, S3 of the tray position sensors 16A, 16B. In case the signal SSTRT is still released and a sheet is ejected from the copier in this state, said sheet is stored in the tray 4-1, and the motor M2 is deactivated to stop the rollers 2, 3 upon termination of the signal SSTRT. In this manner the sorter is brought into the stopped state.

In the present embodiment the trays are moved at first to the lowermost position and are then elevated stepwise at each sheet delivery, but it is also possible to move the tray at first to the uppermost position and to lower them stepwise at each sheet delivery Also the sensors employed in the present embodiment may be composed of microswitches instead of photointerrupters.

Furthermore the dip-switch employed in the present embodiment may be replaced by a seesaw switch, a toggle switch or a shortcircuit bar.

As the releasing timing of the sorter stand-by signal is selectable by the dip-switch according to the connected image forming apparatus such as copier, said sorter stand-by signal may be released simultaneously with the start of tray movement in case the time required for first copying is longer than the time required for maximum movement of the trays.

As explained in the foregoing, the time loss in the first copying can be minimized, since the stand-by signal can be supplied to the image forming apparatus before the sheet handling apparatus becomes ready for sheet handling.

Also a structure with selectable timing of the stand-by signal enables connection with various image forming apparatus of different first recording times.

What is claimed is:

1. A sheet handling apparatus comprising:

storage means for storing sheet members conveyed from a recording unit;

position sensing means for sensing a predetermined position of said storage means to control an operation of said storage means;

signal output means for releasing a signal indicating an available state of said storage means for sheet storage to enable said recording unit to perform the recording operation before said storage means reaches said available state for sheet storage; and means for determining the timing of the output of the signal from said signal output means in accordance with an output of said position sensing means, wherein said predetermined position is determined in such a manner that time required until said storage means reaches said available state since said position sensing means senses said predetermined position is shorter than time required for performing recording operation on the sheet with said recording unit and then transferring the sheet to said storage means.

2. A sheet handling apparatus according to claim 1, wherein said storage means comprises plural trays for sorting and storing sheet members.

3. A sheet handling apparatus according to claim 2, wherein said storage means is adapted to store sheet members by moving said plural trays in such a manner as to bring said plural trays to the transport path of said sheet members.

4. A sheet handling apparatus according to claim 3, wherein said available state is a state in which the first tray to receive the sheet member among said plural trays is in a position corresponding to said sheet transport path.

5. A sheet handling apparatus according to claim 4, wherein said signal output means is adapted to release said signal in different timings in accordance with said predetermined position and the current position of the first tray.

6. A sheet handling apparatus according to claim 5, wherein said signal is released simultaneously with the start of movement of said storage means in case the position of said first tray is nearer than said predetermined position with regard to a home position.

7. A sheet handling apparatus according to claim 5 or 6, wherein said signal is released, awaiting until said position sensing means senses said predetermined position since the start of movement of said storage means, in case the position of said first tray is more far than said predetermined position with regard to a home position.

8. An image forming apparatus comprising:

image forming means for image formation on recording materials;

storage means for storing recording materials after image formation thereon by said image forming means;

position sensing means for sensing a predetermined position of one of said image forming and storage means to control operation of said storage means; and control means for enabling the start of image formation by said image forming means in accordance with a predetermined signal from said storage means before said storage means becomes available for storage, said control means including means for determining the timing of generation of the predetermined signal from said storage means in accordance with an output of said position sensing means, wherein said predetermined position is determined in such a manner that time required until said storage means reaches said available state since said position sensing means senses said predetermined position is shorter than time required for performing recording operation on the sheet with said image forming means and then transferring the sheet to said storage means.

9. A sheet handling apparatus comprising:

storage means for storing sheet members conveyed from a recording unit, said storage means having a plurality of storage sections;

moving means for changing a relative position between a conveyance inlet of the sheet members and the storage sections so that the sheet members are stored in said plurality of storage sections;

memory means for memorizing the relative position changed by said moving means;

signal output means for releasing a signal indicating an available state of said storage means for sheet storage to enable said recording unit to perform the recording operation; and control means for comparing data corresponding to the relative position memorized in said memory means with a predetermined data corresponding to a predetermined position at the time of a returning operation to a home position by said moving means and for controlling an output timing of said signal in accordance with the comparison result.

10. A sheet handling apparatus according to claim 9, wherein said moving means moves said storage sections to said coveyance inlet on a relative movement basis.

11. A sheet handling apparatus according to claim 9, wherein said control means causes said signal output means to output the signal simultaneously with said returning operation in case said relative position memorized in said memory means is determined as more near than said predetermined position with regard to the home position.

12. A sheet handling appratus according to claim 9, wherein said control means causes said signal output means to output the signal, awaiting until said relative position reaches said predetermined position after initiation of the returning operation, in case said relative position memorized in said memory means is determined as more far than said predetermined position with regard to the home position.

* * * * *